US011226569B2

(12) United States Patent
Watanabe

(10) Patent No.: US 11,226,569 B2
(45) **Date of Patent: *Jan. 18, 2022**

(54) MAGENTA TONER

(71) Applicant: ZEON CORPORATION, Tokyo (JP)

(72) Inventor: Masashi Watanabe, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/907,738

(22) Filed: Jun. 22, 2020

(65) Prior Publication Data

US 2020/0319569 A1 Oct. 8, 2020

Related U.S. Application Data

(63) Continuation of application No. 16/319,932, filed as application No. PCT/JP2017/026717 on Jul. 24, 2017, now Pat. No. 10,732,533.

(51) Int. Cl.

| | |
|---|---|
| ***G03G 9/08*** | (2006.01) |
| ***G03G 9/09*** | (2006.01) |
| ***G03G 9/087*** | (2006.01) |

(52) U.S. Cl.

CPC ..... *G03G 9/091* (2013.01); *G03G 9/0821* (2013.01); *G03G 9/0825* (2013.01); *G03G 9/08711* (2013.01); *G03G 9/09* (2013.01); *G03G 9/0908* (2013.01); *G03G 9/0924* (2013.01)

(58) Field of Classification Search

CPC ..... G03G 9/091; G03G 9/0908

See application file for complete search history.

(56) References Cited

U.S. PATENT DOCUMENTS

| | | | |
|---|---|---|---|
| 5,707,769 | A | 1/1998 | Hagi et al. |
| 10,732,533 | B2 * | 8/2020 | Watanabe ..... G03G 9/091 |
| 2003/0207186 | A1 | 11/2003 | Itakura et al. |
| 2006/0046178 | A1 | 3/2006 | Akiyama et al. |
| 2009/0068581 | A1 | 3/2009 | Kusaka et al. |

FOREIGN PATENT DOCUMENTS

| | | | |
|---|---|---|---|
| CN | 101382746 | A | 3/2009 |
| EP | 2 634 635 | A1 | 9/2013 |
| JP | 6-19591 | B2 | 3/1994 |
| JP | 2003-280278 | A | 10/2003 |
| JP | 2004-61686 | A | 2/2004 |
| JP | 2007-286148 | A | 11/2007 |

OTHER PUBLICATIONS

Notification of Transmittal of Translation of the International Preliminary Report on Patentability (Form PCT/IB/338) issued in counterpart International Application No. PCT/JP2017/026717 dated Feb. 7, 2019 with Forms PCT/IB/373 and PCT/ISA/237.

Extended Search Report dated Feb. 7, 2020, issued in counterpart EP Application No. 17834256.4.

Non Final Office Action dated Jul. 18, 2019, U.S. Appl. No. 16/319,932.

Final Office Action dated Oct. 25, 2019, U.S. Appl. No. 16/319,932.

* cited by examiner

*Primary Examiner* — Mark A Chapman

(74) *Attorney, Agent, or Firm* — Westerman, Hattori, Daniels & Adrian, LLP

(57) ABSTRACT

The magenta toner is excellent in image density, has an enhanced chargeability, and can be produced at a low cost. The magenta toner includes a binder resin and a magenta colorant. A compound A represented by the following general formula (1) and C.I. Solvent Violet 59 are contained as the magenta colorant.

General Formula (1)

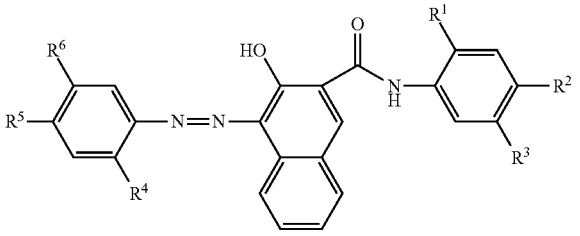

4 Claims, No Drawings

MAGENTA TONER

CROSS-REFERENCE TO RELATED APPLICATION

This application is a continuation of U.S. application Ser. No. 16/319,932, filed on Jan. 23, 2019, which is a 371 of International Application No. PCT/JP2017/026717, filed on Jul. 24, 2017, which is based upon and claims the benefit of priority from the prior Japanese Patent Application No. 2016-150543, filed on Jul. 29, 2016, the entire contents of which are incorporated herein by reference.

TECHNICAL FIELD

The present invention relates to a magenta toner for developing electrostatic latent images formed by electrophotography, electrostatic recording, etc.

BACKGROUND ART

In an image forming device such as an electrophotographic device and an electrostatic recording device, first, an electrostatic latent image formed on the photoconductor is developed with a toner. Next, as needed, a toner image thus formed is transferred onto a transfer material such as a paper sheet and then fixed thereon by various methods such as heating, pressing or solvent vapor. In the field of such an image forming device, a digital full-color copying machine and a digital full-color printer have been put to practical use. A digital full-color copying machine produces a full-color image as follows. First, an original color image is subjected to color separation with blue, green and red filters; an electrostatic latent image corresponding to the original color image, which is composed of dots that are 20 to 70 μm in diameter, is developed with yellow, magenta, cyan and black toners; and a full-color image is formed using the subtractive color mixing effect.

Recently, there is an increasing demand for full-color images with high image quality and high resolution. Especially, to increase color reproducibility, it is hoped that an image can be printed in the same hue as ink printing. For a magenta toner, a quinacridone pigment, a thioindigo pigment, a xanthene pigment, a monoazo pigment, a perylene pigment, a diketo pyrrolo pyrrole pigment or the like are used solely or mixed to use. Of these, a combination use of the quinacridone pigment with the other magenta pigment is investigated in the viewpoint of excellent weather resistance, thermal resistance and transparency.

Patent Literature 1 offers a magenta toner in which the quinacridone pigment is used in combination with the monoazo pigment, and discloses, in Examples, toners containing C.I. Pigment Red 122, C.I. Pigment Red 19 and C.I. Pigment Red 185.

Patent Literature 2 offers a magenta toner in which the quinacridone pigment is added to the monoazo pigment, and discloses, in Examples, toners containing C.I. Pigment Red 146 and C.I. Pigment Red 122.

In addition to the combination use among magenta pigments, an example of attempt to improve toner properties by combining a magenta pigment and a magenta dye is known.

Patent Literature 3 discloses a magenta toner containing C.I. Pigment Red 122 and an oily dye. Patent Literature 3 describes that a magenta toner with a wide range of color space, an excellent color reproducibility and an excellent transparency can be obtained by mixing these colorants in a specific ratio.

CITATION LIST

Patent Literature 1: Japanese Patent Application Laid-Open (JP-A) No. 2004-61686

Patent Literature 2: JP-A No. 2003-280278

Patent Literature 3: JP-A No. 2007-286148

SUMMARY OF INVENTION

Technical Problem

The applications of an electrophotographic image forming device have been extended from general copying machines and printers used to print or copy office documents, to the field of production of printed matters for use outside the office, in particular, to the print-on-demand (POD) market that is an area of quick printing, since the image forming device can easily print variable information from electronic data. Therefore, in recent years, the level of demand required of the reflection density and chroma of a printed product has been rapidly increased.

The magenta toner disclosed in Patent Literature 1 tends to show a low image density, and needs to use a large amount of a pigment, and involves a high cost.

Especially, the quinacridone pigment such as C.I. Pigment Red 122 is expensive and difficult to be used as toners for a common use.

C.I. Pigment Red 146 used in Patent Literature 2 is cheap in comparison with the quinacridone pigment, but it is insufficient in a chargeability of toner.

On the other hand, the dye used in Patent Literature 3 possesses properties different from pigments, and it is dissolvable in a solvent and weak to light. Thus, in a case where the dye and the pigment are used in combination and a content ratio of the dye is excessively large, a light resistance is deteriorated, and it is problematic. Accordingly, content ratios of the dye and the pigment are self-restricted.

An object of the present invention is to provide a magenta toner which shows an excellent image density, and has an enhanced chargeability, and can be produced at a low cost.

Solution to Problem

To attain the object, the inventor of the present invention conducted detailed research and found the following: A combination use of compounds A and B as a magenta colorant, each of which has a specific chemical structure makes it possible to obtain a magenta toner which shows an excellent image density, and has an enhanced chargeability, and can be produced at a low cost. Based on this finding, the inventor achieved the present invention.

The magenta toner of the present invention is a magenta toner comprising a binder resin and a magenta colorant, wherein a compound A represented by the following general formula (1) and a compound B represented by the following general formula (2) are contained as the magenta colorant, and wherein a total content of the compound A and the compound B is from 3 to 30 parts by mass with respect to 100 parts by mass of the binder resin, and a mass ratio of the content of the compound A to the content of the compound B (compound A/compound B) is from 0.8 to 20:

General Formula (1)

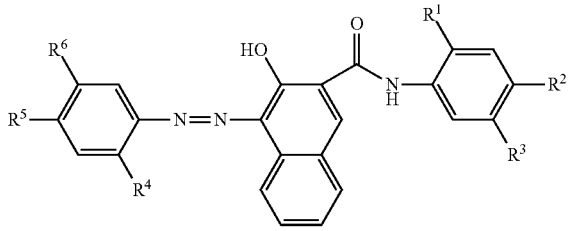

where $R^1$ is a hydrogen atom, an alkyl group or an alkoxy group;

$R^2$ is a hydrogen atom, a halogen atom or an alkoxy group;

$R^3$ is a hydrogen atom, a halogen atom, an alkoxy group or a nitro group;

$R^4$ is a hydrogen atom, a halogen atom or an alkoxy group;

$R^5$ is a hydrogen atom, a halogen atom or a primary amide group (—$CONH_2$); and $R^6$ is a hydrogen atom, a halogen atom, a phenylaminocarbonyl group (—$CONHC_6H_5$), a primary amide group (—$CONH_2$), —$CONHC_6H_4$— (p) $CONH_2$ or —$SO_2$ $(C_2H_5)_2$, General Formula (2)

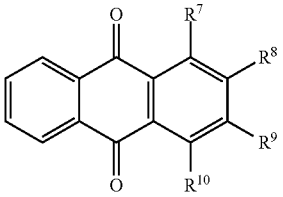

where $R^2$ and $R^{10}$ are each independently an amino group or a hydroxyl group; and $R^8$ and $R^9$ are each independently a hydrogen atom, a halogen atom or a phenoxy group (—$OC_6H_5$) which may be substituted or not substituted.

In the present invention, the compound A is preferably a compound represented by the General Formula (1) in which:

$R^1$ is a methyl group or an alkoxy group;

$R^2$ is a hydrogen atom or a halogen atom;

$R^3$ is a halogen atom or an alkoxy group;

$R^4$ is an alkoxy group;

$R^5$ is a hydrogen atom; and $R^6$ is a phenylaminocarbonyl group (—$CONHC_6H_5$).

Use of the compound A as described above makes it possible to provide a magenta toner which shows an excellent image density, and has an enhanced chargeability, and can be produced at a low cost.

In the present invention, the compound A is preferably C.I. Pigment Red 146 or C.I. Pigment Red 147, and the compound B is preferably C.I. Solvent Violet 59.

By using, C.I. Pigment Red 146 or C.I. Pigment Red 147 in combination with C.I. Solvent Violet 59 both as the magenta colorant, a magenta toner which shows an excellent image density, and has an enhanced chargeability, and can be produced at a low cost can be provided.

In the present invention, it is preferable for the magenta toner that an absolute value of a blow-off charge amount measured by a blow-off charge amount measuring device is in a range of from 25 μC/g to 90 μC/g.

Since the toner having an sufficient chargeability can be obtained by using a combination of the compound A and compound B both as the magenta colorant, a magenta toner which is inhibited from generating fog can be provided.

Advantageous Effects of Invention

According to the present invention as described above, by using the compound A having the chemical structure represented by the general formula (1) in combination with the compound B having the chemical structure represented by the general formula (2), the magenta toner which shows an excellent image density, and has an enhanced chargeability, and can be produced at a low cost can be provided.

DESCRIPTION OF EMBODIMENTS

The magenta toner of the present invention is a magenta toner comprising a binder resin and a magenta colorant, wherein a compound A represented by the following general formula (1) and a compound B represented by the following general formula (2) are contained as the magenta colorant, and wherein a total content of the compound A and the compound B is from 3 to 30 parts by mass with respect to 100 parts by mass of the binder resin, and a mass ratio of the content of the compound A to the content of the compound B (compound A/compound B) is from 0.8 to 20:

General Formula (1)

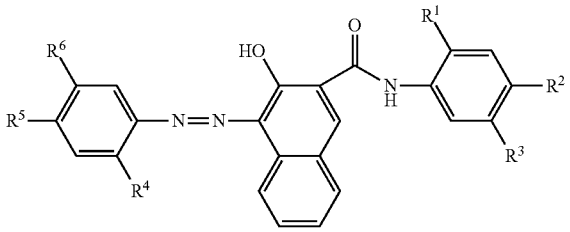

where $R^1$ is a hydrogen atom, an alkyl group or an alkoxy group;

$R^2$ is a hydrogen atom, a halogen atom or an alkoxy group;

$R^3$ is a hydrogen atom, a halogen atom, an alkoxy group or a nitro group;

$R^4$ is a hydrogen atom, a halogen atom or an alkoxy group;

$R^5$ is a hydrogen atom, a halogen atom or a primary amide group (—$CONH_2$); and $R^6$ is a hydrogen atom, a halogen atom, a phenylaminocarbonyl group (—$CONHC_6H_5$), a primary amide group (—$CONH_2$), —$CONHC_6H_4$-(p) $CONH_2$ or —$SO_2$ $(C_2H_5)_2$, General Formula (2)

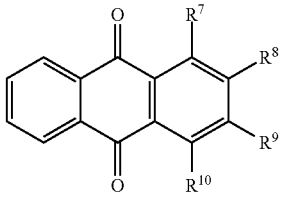

where $R^7$ and $R^{10}$ are each independently an amino group or a hydroxyl group; and $R^8$ and $R^9$ are each independently a hydrogen atom, a halogen atom or a phenoxy group ($—OC_6H_5$) which may be substituted or not substituted.

The binder resin is incorporated to furnish toner base particles of the magenta toner with their forms and functions.

Hereinafter, the magenta toner of the present invention may be simply referred to as "toner".

Hereinafter, a method for producing magenta colored resin particles used in the present invention (hereinafter they may be simply referred to as "colored resin particles"), magenta colored resin particles obtained by the production method, a method for producing a magenta toner using the magenta colored resin particles, and the magenta toner of the present invention will be described in order.

1. Method for Producing Colored Resin Particles

Generally, methods for producing colored resin particles are broadly classified into dry methods such as a pulverization method and wet methods such as an emulsion polymerization agglomeration method, a suspension polymerization method and a solution suspension method. The wet methods are preferred since a toner that has excellent printing characteristics such as image reproducibility can be easily obtained. Among the wet methods, polymerization methods such as the emulsion polymerization agglomeration method and the suspension polymerization method are preferred, since a toner that has relatively small particle size distribution in micron order can be easily obtained. Among the polymerization methods, the suspension polymerization method is more preferred.

The emulsion polymerization agglomeration method is a method for producing colored resin particles by polymerizing emulsified polymerizable monomers to obtain a resin microparticle emulsion, and aggregating the resulting resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be carried out by known methods.

The colored resin particles used in the present invention can be produced by the wet methods or the dry methods. The wet methods are preferred, and among the wet methods, the suspension polymerization method is particularly preferred. By the suspension polymerization method, the colored resin particles are produced through the processes described below.

(A) Suspension Polymerization Method (A-1) Preparation Process of Polymerizable Monomer Composition First, a polymerizable monomer, a magenta colorant, and other additives added as needed, such as a charge control agent and a release agent, are mixed to prepare a polymerizable monomer composition. For example, a media type dispersing machine is used for the mixing in the preparation of the polymerizable monomer composition.

In the present invention, the polymerizable monomer means a monomer having a polymerizable functional group, and the polymerizable monomer is polymerized into a binder resin. As a main component of the polymerizable monomer, a monovinyl monomer is preferably used. As the monovinyl monomer, examples include, but are not limited to, styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and derivatives of acrylic acids or methacrylic acids are preferably used as the monovinyl monomer.

In order to improve hot offset and storage stability, it is preferable to use a crosslinkable polymerizable monomer together with the monovinyl monomer. The crosslinkable polymerizable monomer means a monomer having two or more polymerizable functional groups. As the crosslinkable polymerizable monomer, examples include, but are not limited to, aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer is generally from 0.1 to 5 parts by mass, and preferably from 0.3 to 2 parts by mass, with respect to 100 parts by mass of the monovinyl monomer.

Also, it is preferable to use a macromonomer as a part of the polymerizable monomer, since the balance between the storage stability and low-temperature fixability of the toner to be obtained can be improved. The macromonomer is a reactive oligomer or polymer having a polymerizable carbon-carbon unsaturated double bond at the end of a polymer chain and generally having a number average molecular mass of from 1,000 to 30,000. The macromonomer is preferably one that can provide a polymer having a higher glass transition temperature (hereinafter may be referred to as "Tg") than a polymer obtained by polymerization of a monovinyl monomer. The amount of the macromonomer is preferably from 0.03 to 5 parts by mass, and more preferably from 0.05 to 1 part by mass, with respect to 100 parts by mass of the monovinyl monomer.

In the present invention, the compound A and the compound B are contained as the magenta colorant.

Hereinafter, the compound A used in the present invention will be described in detail.

The compound A of the present invention is a naphthol-base azo compound represented by the following general formula (1):

General Formula (1)

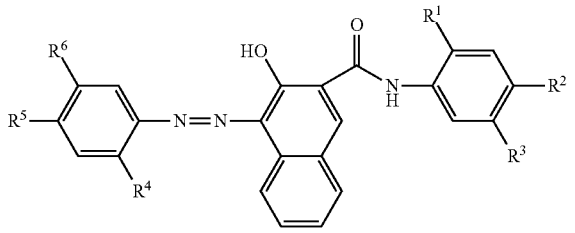

In the general formula (1), $R^1$ is a hydrogen atom, an alkyl group or an alkoxy group. $R^1$ is preferably a methyl group or an alkoxy group, more preferably a methyl group or a methoxy group, and still more preferably a methoxy group.

In the general formula (1), $R^2$ is a hydrogen atom, a halogen atom or an alkoxy group. $R^2$ is preferably a hydrogen atom or a halogen atom, more preferably a hydrogen atom or a chlorine atom, and still more preferably a chlorine atom.

In the general formula (1), $R^3$ is a hydrogen atom, a halogen atom, an alkoxy group or a nitro group. $R^3$ is preferably a halogen atom or an alkoxy group, more preferably a chlorine atom or a methoxy group, and still more preferably a methoxy group.

In the general formula (1), $R^4$ is a hydrogen atom, a halogen atom or an alkoxy group. $R^4$ is preferably a methoxy group or a chlorine atom, and more preferably a methoxy group.

In the general formula (1), $R^5$ is a hydrogen atom, a halogen atom or a primary amide group (—$CONH_2$). $R^5$ is preferably a hydrogen atom or a chlorine atom, and more preferably a hydrogen atom.

In the general formula (1), $R^6$ is a hydrogen atom, a halogen atom, a phenylaminocarbonyl group (—$CONHC_6H_5$), a primary amide group (—$CONH_2$), —$CONHC_6H_4$-(p)$CONH_2$ or —$SO_2(C_2H_5)_2$. $R^6$ is preferably a phenylaminocarbonyl group (—$CONHC_6H_5$) or a primary amide group (—$CONH_2$), and more preferably a phenylaminocarbonyl group (—$CONHC_6H_5$).

As the compound A represented by the general formula (1), examples include the following compounds. Of the following examples, the compound represented by the following formula (1A) is C.I. Pigment Red 146 (CAS No. 5280-68-2), and the compound represented by the following formula (1B) is C.I. Pigment Red 147 (CAS No. 68227-78-1), and the compound represented by the following formula (1C) is C.I. Pigment Red 269 (CAS No. 67990-05-0). The examples further include C.I. Pigment Red 31 (CAS No. 6448-96-0), C.I. Pigment Red 32 (CAS No. 6410-29-3), and C.I. Pigment Red 187 (CAS No. 59487-23-9).

The compound A used in the present invention is not limited to the following examples. Tautomers of the following examples can be also preferably used as the compound A of the present invention.

Formula (1A)

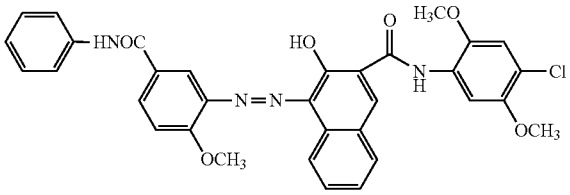

Formula (1B)

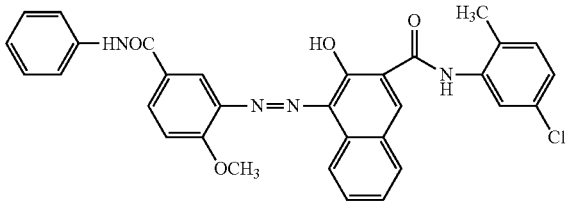

Formula (1C)

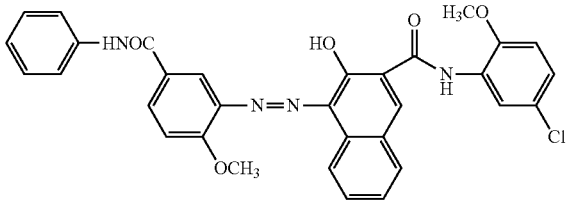

The compound A may be a commercially-available product or may be synthesized in accordance with common synthesizing manner for azo pigments. In one of the common synthesizing manner for azo pigments, a diazo compound of an aromatic amine is react with a coupling material of a β-naphthol derivative which is dissolved in an alkali aqueous solution such as sodium hydroxide (Hiromitsu Katsura, COLORING MATERIALS, Vol. 55, No. 10, pp. 742-757 (1982)).

In the present invention, besides the compound A, the compound B which is an anthraquinone base dye represented by the following general formula (2) is contained as the magenta colorant.

General Formula (2)

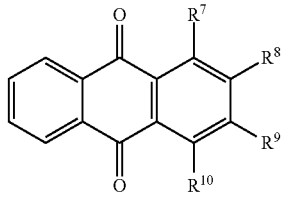

In the general formula (2), $R^7$ and $R^{10}$ are each independently an amino group or a hydroxyl group. $R^7$ and $R^{10}$ are preferably an amino group.

In the general formula (2), $R^8$ and $R^9$ are each independently a hydrogen atom, a halogen atom or a phenoxy group (—$OC_6H_5$) which may be substituted or not substituted. $R^8$ and $R^9$ are preferably a not substituted phenoxy group (—$OC_6H_5$).

As the compound B represented by the general formula (2), examples include the following compounds. Of the following examples, the compound represented by the following formula (2A) is C.I. Solvent Violet 59 (CAS No.

6408-72-6) and the compound represented by the following formula (2B) is C.I. Solvent Violet 31 (CAS No. 81-42-5).

The compound B used in the present invention is not limited to the following examples. Tautomers of the following examples can be also preferably used as the compound A of the present invention.

Formula (2A)

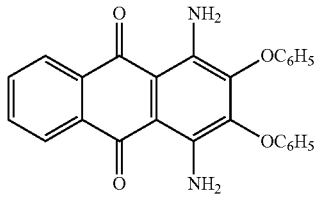

Formula (2B)

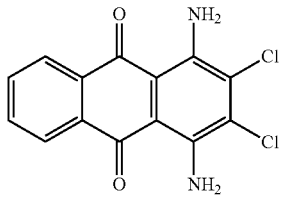

With respect to 100 parts by mass of the binder resin, the total content of the compound A and the compound B is from 3 to 30 parts by mass, preferably form 4 to 25 parts by mass, more preferably from 5 to 20 parts by mass, and still more preferably from 6 to 18 parts by mass.

When the total content of the compound A and the compound B is less than 3 part by mass with respect to 100 parts by mass of the binder resin, an aimed level of image density is not obtained. On the other hand, when the total content is more than 30 parts by mass, low temperature fixability is deteriorated.

In the present invention, the mass ratio of the content of the compound A to the content of the compound B (compound A/compound B) is from 0.8 to 20.

When the mass ratio is less than 0.8, the content of the compound B is too large and results in poor light resistance. This is because a dye like the compound B is liable to UV-induced color deterioration. On the other hand, when the mass ratio is more than 20, image density (reflection density) is decreased. Since the mass ratio (compound A/compound B) is from 0.8 to 20, an image density (reflection density) and a light resistance can be increased with a good balance.

The content of the compound A is preferably from 1 to 28 parts by mass, more preferably form 3 to 20 parts by mass, and still more preferably from 4 to 15 parts by mass, with respect to 100 parts by mass of the binder resin. When the content of the compound A is less than 1 part by mass with respect to 100 parts by mass of the binder resin, a remarkable decrease in reflection density may occur. When the content of the compound A is more than 28 parts by mass with respect to 100 parts by mass of the binder resin, low-temperature fixability is deteriorated.

The content of the compound B is preferably from 0.5 to 12 parts by mass, more preferably from 0.7 to 9 parts by mass, and still more preferably from 1.0 to 6 parts by mass, with respect to 100 parts by mass of the binder resin. When the content of the compound B is less than 0.5 part by mass with respect to 100 parts by mass of the binder resin, an aimed level of chroma may not be obtained. When the content of the compound B is more than 12 parts by mass with respect to 100 parts by mass of the binder resin, poor light resistance may be obtained. This is because a dye like the compound B is liable to UV-induced color deterioration.

As another additive, a positively or negatively chargeable charge control agent can be used to improve the chargeability of the toner.

The charge control agent is not particularly limited, as long as it is one that is generally used as a charge control agent for toners. Among charge control agents, a positively or negatively chargeable charge control resin is preferred, since the charge control resin is highly compatible with the polymerizable monomer and can impart stable chargeability (charge stability) to the toner particles. From the viewpoint of obtaining a negatively chargeable toner, a negatively chargeable charge control resin is more preferred.

As the positively chargeable charge control agent, examples include, but are not limited to, a nigrosine dye, a quaternary ammonium salt, a triaminotriphenylmethane compound, an imidazole compound, a polyamine resin, a quaternary ammonium group-containing copolymer, and a quaternary ammonium salt group-containing copolymer, which are preferably used as the charge control resin.

As the negatively chargeable charge control agent, examples include, but are not limited to, an azo dye containing a metal such as Cr, Co, Al and Fe; a metal salicylate compound; a metal alkylsalicylate compound; and a sulfonic acid group-containing copolymer, a sulfonic acid salt group-containing copolymer, a carboxylic acid group-containing copolymer and a carboxylic acid salt group-containing copolymer, which are preferably used as the charge control resin.

Weight average molecular weight (Mw) of the charge control resin expressed by a value equivalent to polystyrene, which is measured by the gel permeation chromatography (GPC) using tetrahydrofuran, is in a range of from 5,000 to 30,000, preferably from 8,000 to 25,000, and more preferably from 12,000 to 22,000.

Copolymerization ratio of a monomer having a functional group such as a quaternary ammonium group, a sulfonic acid salt group or the like in the charge control resin is generally in a range of from 0.5 to 12 percent by mass, preferably from 1.0 to 6 percent by mass, and more preferably from 1.5 to 3 percent by mass.

In the present invention, it is desirable that the amount of the charge control agent is generally from 0.01 to 10 parts by mass, and preferably from 0.03 to 8 parts by mass, with respect to 100 parts by mass of the monovinyl monomer. When the added amount of the charge control agent is less than 0.01 part by mass, fog may occur. On the other hand, when the added amount of the charge control agent is more than 10 parts by mass, soiling in printing may occur.

As another additive, a molecular weight modifier is preferably used in the polymerization of the polymerizable monomer that is polymerized into a binder resin.

The molecular weight modifier is not particularly limited, as long as it is one that is generally used as a molecular weight modifier for toners. As the molecular weight modifier, examples include, but are not limited to, mercaptans such as t-dodecyl mercaptan, n-dodecyl mercaptan, n-octyl mercaptan and 2,2,4,6,6-pentamethylheptane-4-thiol, and thiuram disulfides such as tetramethyl thiuram disulfide, tetraethyl thiuram disulfide, tetrabutyl thiuram disulfide, N,N'-dimethyl-N,N'-diphenyl thiuram disulfide, and N,N'-dioctadecyl-N,N'-diisopropyl thiuram disulfide. These molecular weight modifiers may be used alone or in combination of two or more kinds.

In the present invention, it is desirable that the amount of the molecular weight modifier is generally from 0.01 to 10 parts by mass, and preferably 0.1 to 5 parts by mass, with respect to 100 parts by mass of the monovinyl monomer.

As another additive, it is preferable to add a release agent. By adding the release agent, the releasability of the toner from a fixing roller upon fixing, can be improved. The release agent is not particularly limited, as long as it is one that is generally used as a release agent in toner. As the release agent, examples include, but are not limited to, low-molecular-weight polyolefin waxes and modified waxes thereof; natural plant waxes such as jojoba; petroleum waxes such as paraffin; mineral waxes such as ozokerite; synthetic waxes such as Fischer-Tropsch wax; and polyalcohol esters such as dipentaerythritol ester. Of them, polyalcohol esters are preferred since the toner can achieve a balance between storage stability and low-temperature fixability. These release agents may be used alone or in combination of two or more kinds.

The amount of the release agent is preferably from 0.1 to 30 parts by mass, and more preferably from 1 to 20 parts by mass, with respect to 100 parts by mass of the monovinyl monomer.

(A-2) Suspension Process of Obtaining Suspension (Droplets Forming Process)

In the present invention, the polymerizable monomer composition containing the polymerizable monomer and the magenta colorant is dispersed in an aqueous medium containing a dispersion stabilizer, and a polymerization initiator is added therein. Then, the polymerizable monomer composition are formed into droplets. The method for forming the droplets is not particularly limited. For example, the droplets are formed by means of a device capable of strong stirring, such as an (in-line type) emulsifying and dispersing machine (product name: MILDER, manufactured by: Pacific Machinery & Engineering Co., Ltd.) and a high-speed emulsifying and dispersing machine (product name: T. K. HOMOMIXER MARK II, manufactured by: PRIMIX Corporation).

As the polymerization initiator, examples include, but are not limited to, persulfates such as potassium persulfate and ammonium persulfate; azo compounds such as 4,4'-azobis (4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butylperoxyoxyisophthalate and t-butylperoxyisobutyrate. They can be used alone or in combination of two or more kinds. Among them, organic peroxides are preferred since they can reduce residual polymerizable monomer and impart excellent printing durability.

Among organic peroxides, preferred are peroxy esters, and more preferred are non-aromatic peroxy esters, i.e., peroxy esters having no aromatic ring, since they have excellent initiator efficiency and can reduce residual polymerizable monomer.

The polymerization initiator may be added after the polymerizable monomer composition is dispersed into the aqueous medium and before the polymerizable monomer composition is formed into droplets as described above, or it may be added to the polymerizable monomer composition before the polymerizable monomer composition is dispersed into the aqueous medium.

The added amount of the polymerization initiator used for the polymerization of the polymerizable monomer composition, is preferably from 0.1 to 20 parts by mass, more preferably from 0.3 to 15 parts by mass, and even more preferably from 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. As the dispersion stabilizer, examples include, but are not limited to, inorganic compounds including sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron(II) hydroxide, and organic compounds including water-soluble polymers such as polyvinyl alcohol, methyl cellulose and gelatin, anionic surfactants, nonionic surfactants, and ampholytic surfactants. These dispersion stabilizers can be used alone or in combination of two or more kinds.

Among the above dispersion stabilizers, preferred are colloids of inorganic compounds, and particularly preferred is a colloid of a hardly water-soluble metal hydroxide. By using a colloid of an inorganic compound, particularly a colloid of a hardly water-soluble metal hydroxide, the colored resin particles can have a narrow particle size distribution, and the amount of the dispersion stabilizer remaining after washing can be small, so that the polymerization toner thus obtained can clearly reproduce an image and does not deteriorate environmental stability.

(A-3) Polymerization Process

Formation of the droplets is carried out as described under the above (A-2). The thus-obtained aqueous dispersion medium is heated to polymerize, thereby forming an aqueous dispersion containing the magenta colorant.

The polymerization temperature of the polymerizable monomer composition is preferably 50° C. or more, and more preferably from 60 to 95° C. The polymerization reaction time is preferably from 1 to 20 hours, and more preferably from 2 to 15 hours.

The colored resin particles may be used as they are as a polymerization toner, or they may be mixed with an external additive and used as a polymerization toner. It is preferable that the colored resin particles are so-called core-shell type (or "capsule type") colored resin particles obtained by using the colored resin particles as a core layer and forming a shell layer, which is a layer that is different from the core layer, around the core layer. By covering the core layer composed of a substance having a low softening point with a substance having a higher softening point, the core-shell type colored resin particles can achieve a balance between lowering of fixing temperature and prevention of aggregation during storage.

A method for producing the above-mentioned core-shell type colored resin particles using the colored resin particles, is not particularly limited. The core-shell type colored resin particles can be produced by a conventional method. The in situ polymerization method and the phase separation method are preferable from the viewpoint of production efficiency.

Hereinafter, the method for producing the core-shell type colored resin particles by the in situ polymerization method, will be described.

The core-shell type colored resin particles can be obtained by adding a polymerizable monomer for forming a shell layer (a polymerizable monomer for shell) and a polymerization initiator to an aqueous medium in which the colored resin particles are dispersed, and then polymerizing the mixture.

As the polymerizable monomer for shell, the above-mentioned polymerizable monomers can be used. Among the polymerizable monomers, it is preferable to use monomers that can provide a polymer having a Tg of more than 80° C., such as styrene, acrylonitrile and methyl methacrylate, alone or in combination of two or more kinds.

As the polymerization initiator used for polymerization of the polymerizable monomer for shell, examples include, but are not limited to, water-soluble polymerization initiators including metal persulfates such as potassium persulfate and ammonium persulfate, and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl)propionamide). These polymerization initiators can be used alone or in combination of two or more kinds. The amount of the polymerization initiator is preferably from 0.1 to 30 parts by mass, and more preferably from 1 to 20 parts by mass, with respect to 100 parts by mass of the polymerizable monomer for shell.

The polymerization temperature of the shell layer is preferably 50° C. or more, and more preferably from 60 to 95° C. The polymerization reaction time is preferably from 1 to 20 hours, and more preferably from 2 to 15 hours.

(A-4) Washing, Filtering, Dehydrating and Drying Processes

After the polymerization is completed, the aqueous dispersion of the colored resin particles obtained by the polymerization is preferably subjected to operations of filtering, washing for removal of the dispersion stabilizer, dehydrating and drying, several times as needed, according to a conventional method.

The washing is preferably carried out by the following method. When the inorganic compound is used as the dispersion stabilizer, acid or alkali is added to the aqueous dispersion of the colored resin particles, thereby dissolving the dispersion stabilizer in water and removing it. When the colloid of the hardly water-soluble inorganic hydroxide is used as the dispersion stabilizer, the pH of the aqueous dispersion of the colored resin particles is controlled to 6.5 or less by adding acid. As the acid, examples include, but are not limited to, inorganic acids such as sulfuric acid, hydrochloric acid and nitric acid, and organic acids such as formic acid and acetic acid. Sulfuric acid is particularly preferred for its high removal efficiency and small impact on production facilities.

The dehydrating and filtering method is not particularly limited and can be selected from various known methods. As the method, examples include, but are not limited to, a centrifugal filtration method, a vacuum filtration method and a pressure filtration method. Also, the drying method is not particularly limited and can be selected from various methods.

(B) Pulverization Method

In the case of producing the colored resin particles by employing the pulverization method, the colored resin particles are produced by the following processes.

First, a binder resin, a magenta colorant, and other additives added as needed, such as a charge control agent and a release agent, are mixed by means of a mixer such as a ball mill, a V-type mixer, FM MIXER (product name), a high-speed dissolver, an internal mixer or Forberg.

Next, while heating the thus-obtained mixture, the mixture is kneaded by means of a press kneader, a twin screw kneading machine, a roller or the like. The thus-obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into a desired particle diameter by means of a classifier such as a wind classifier or an airflow classifier, thereby obtaining the colored resin particles produced by the pulverization method.

In the pulverization method, those that are provided above under "(A) Suspension polymerization method" can be used as the binder resin, the magenta colorant, and the other additives added as needed, such as the charge control agent and the release agent. Similarly to the colored resin particles obtained by the above "(A) Suspension polymerization method", the colored resin particles obtained by the pulverization method can be core-shell type colored resin particles by a method such as the in situ polymerization method.

As the binder resin, resins that have been widely used for toners can be used. As the binder resin used in the pulverization method, examples include, but are not limited to, polystyrene, styrene-butyl acrylate copolymers, polyester resins and epoxy resins.

2. Colored Resin Particles

The colored resin particles containing the magenta colorant are obtained by the production method such as the above-mentioned "(A) Suspension polymerization method" or "(B) Pulverization method".

Hereinafter, the colored resin particles constituting the toner will be described. The colored resin particles described below encompass both core-shell type colored resin particles and colored resin particles of other types.

The volume average particle diameter (Dv) of the colored resin particles is preferably from 3 to 15 μm, and more preferably from 4 to 12 μm. When the volume average particle diameter (Dv) is less than 3 μm, the flowability of the polymerization toner decreases and may deteriorate transferability or decrease image density. When the volume average particle diameter (Dv) is more than 15 μm, image resolution may decrease.

For the colored resin particles, the ratio (Dv/Dn) of the volume average particle diameter (Dv) and the number average particle diameter (Dn) is preferably from 1.0 to 1.3, and more preferably from 1.0 to 1.2. When the ratio Dv/Dn is more than 1.3, there may be a decrease in transferability, image density and resolution. The volume average particle diameter and number average particle diameter of the colored resin particles can be measured by means of a particle size analyzer (product name: MULTISIZER, manufactured by: Beckman Coulter, Inc.), for example.

The average circularity of the colored resin particles of the present invention is preferably from 0.96 to 1.00, more preferably from 0.97 to 1.00, and even more preferably from 0.98 to 1.00, from the viewpoint of image reproducibility.

When the average circularity of the colored resin particles is less than 0.96, thin line reproducibility in printing may deteriorate.

As the toner of the present invention, the colored resin particles containing the magenta colorant can be used as they are. From the viewpoint of controlling the chargeability, flowability and storage stability of the toner, the colored resin particles may be used as a one-component toner by mixing and stirring the colored resin particles with the external additives to attach the external additives to the surface of the colored resin particles.

The one-component toner may be mixed and stirred with carrier particles to obtain a two-component developer.

A mixer is used to add the external additives on the colored resin particles. The mixer is not particularly limited, as long as it is a mixing device that can adhere the external additives to the surface of the colored resin particles. For example, the external additives can be added on the colored resin particles by means of a mixer that is capable of mixing and stirring, such as FM MIXER (product name, manufactured by: Nippon Coke & Engineering Co., Ltd.), SUPER MIXER (product name, manufactured by: Kawata Manufacturing Co., Ltd.), Q MIXER (product name, manufactured by: Nippon Coke & Engineering Co., Ltd.), MECHANOFUSION SYSTEM (product name, manufactured by: Hosokawa Micron Corporation) and MECHANOMILL (product name, manufactured by: Okada Seiko Co., Ltd.)

As the external additives, examples include, but are not limited to, inorganic fine particles composed of silica, titanium oxide, aluminum oxide, zinc oxide, tin oxide, calcium carbonate, calcium phosphate and/or cerium oxide, and organic fine particles composed of polymethyl methacrylate resin, silicone resin and/or melamine resin. Of them, inorganic fine particles are preferred. Of inorganic fine particles, silica and/or titanium oxide is preferred, and fine particles composed of silica are particularly preferred.

These external additives can be used alone. However, it is preferable to use them in combination of two or more kinds.

In the present invention, it is desirable that the external additives are used in an amount of generally from 0.05 to 6 parts by mass, preferably from 0.2 to 5 parts by mass, with respect to 100 parts by mass of the colored resin particles. When the added amount of the external additives is less than 0.05 part by mass, toner transferability may decrease. When the added amount of the external additives is more than 6 parts by mass, fog may occur.

4. Toner of the Present Invention

The toner of the present invention obtained through the above steps uses the combination of the compound A and the compound B as the magenta colorant: therefore, the toner of the present invention is a magenta toner which shows an excellent image density, and has an enhanced chargeability, and can be produced at a low cost. Based on this finding, the inventor achieved the present invention.

The absolute value of a blow-off charge amount of the toner produced in the present invention is preferably in a range of from 25 μC/g to 90 μC/g, more preferably from 30 μC/g to 80 μC/g, and still more preferably from 40 μC/g to 70 μC/g.

A blow-off charge amount is a value measured by a blow-off charge amount measuring device based on a blow-off method.

When the blow-off charge amount is less than the above described range, deterioration of image quality is likely to occur due to fog or the like which is caused by increase of reverse charged toners or the like, and a harmful influence may be brought on the printing performance.

EXAMPLES

Hereinafter, the present invention will be described further in detail, with reference to examples and comparative examples. However, the scope of the present invention may not be limited to the following examples. Herein, "part(s)" and "%" are based on mass if not particularly mentioned.

1. Production of Colored Resin Particles

<Colored Resin Particles (1)>

1-1. Preparation of Polymerizable Monomer Composition for Core

The following raw materials were subjected to wet grinding by means of a media-type disperser (product name: PICO MILL, manufactured by: Asada Iron Works Co., Ltd.): 75 parts of styrene, 25 parts of n-butyl acrylate, 0.1 part of a polymethacrylic acid ester macromonomer (product name: AA6, manufactured by: TOAGOSEI Co., Ltd., Tg: 94° C.), 0.7 part of divinylbenzene, 1.0 part of tetraethylthiuram disulfide and, as magenta colorant, 4.8 parts of C.I. Pigment Red 146 (represented by the following formula (1A), CAS No. 5280-68-2, manufactured by: Clariant Corp., product name: PERMANENT CARMINE FBB02) and 1.2 parts of C.I. Solvent Violet 59 (represented by the following formula (2A), CAS No. 6408-72-6, manufactured by: Clariant Corp., product name: SOLVAPERM RED VIOLET R). To a mixture obtained by the wet grinding, 2.0 parts of a charge control resin (sulfonic acid group-containing styrene-acrylate copolymer, copolymerization ratio of the monomer having a functional group: 2.5%, weight average molecular weight (Mw): 18,000), 2.0 parts of an ester wax (polyhydric alcohol ester, manufactured by: NOF Corporation), and 5.0 parts of a paraffin wax (manufactured by: Nippon Seiro Co., LTD.) were added, mixed and dissolved to obtain a polymerizable monomer composition.

Formula (1A)

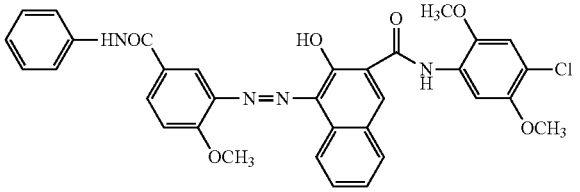

Formula (2A)

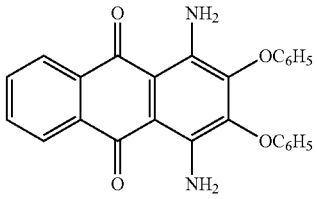

1-2. Preparation of Aqueous Dispersion Medium

An aqueous solution of 7.3 parts of sodium hydroxide dissolved in 50 parts of ion-exchanged water, was gradually added to an aqueous solution of 10.4 parts of magnesium chloride dissolved in 280 parts of ion-exchanged water, while stirring, thereby preparing a magnesium hydroxide colloid dispersion.

1-3. Preparation of Polymerizable Monomer for Shell

Meanwhile, 2 parts of methyl methacrylate and 130 parts of water were subjected to a fine dispersion treatment by means of an ultrasonic emulsifying machine, thereby preparing an aqueous dispersion of a polymerizable monomer for shell.

1-4. Droplets Forming Process

The polymerizable monomer composition was put in the magnesium hydroxide colloid dispersion (the magnesium hydroxide colloid amount: 5.3 parts) and stirred. Then, as a polymerization initiator, 6 parts of t-butylperoxy-2-ethylhexanoate was added thereto. The dispersion containing the polymerization initiator was subjected to dispersion at 15,000 rpm using an in-line type emulsifying and dispersing machine (product name: MILDER, manufactured by: Pacific Machinery & Engineering Co., Ltd.), thereby forming the polymerizable monomer composition into droplets.

1-5. Suspension Polymerization Process

The dispersion containing the droplets of the polymerizable monomer composition was put in a reactor. The temperature thereof was increased to 90° C. to start a polymerization reaction. After the polymerization conversion rate reached almost 100%, a solution obtained by dissolving 0.1 part of 2,2'-azobis[2-methyl-N-(2-hydroxyethyl)-propionamide] (a water-soluble polymerization initiator, product name: VA-086, manufactured by: Wako Pure Chemical Industries, Ltd.) in the aqueous dispersion for the polymerizable monomer for shell, was added in the reactor. Next, the temperature of the reactor was kept at 95° C. for 4 hours to continue the polymerization further. Then, the reactor was cooled by water to stop the reaction, thereby obtaining an aqueous dispersion of core-shell type colored resin particles.

1-6. Post-Treatment Process

The aqueous dispersion of the colored resin particles was subjected to acid washing (25° C., 10 minutes) in which, while stirring the aqueous dispersion, sulfuric acid was added thereto until the pH of the aqueous dispersion was 4.5 or less. Then, the colored resin particles were separated from the aqueous dispersion by filtration and washed with water. The washing water was filtered. A filtrate thus obtained had an electrical conductivity of 20 μS/cm. The colored resin particles subjected to the washing and filtering processes were dehydrated and dried to obtain dried colored resin particles (1).

<Colored Resin Particles (2)>

Colored resin particles (2) were obtained in the same manner as the production method of the colored resin particles (1), except that in the "Preparation of polymerizable monomer composition for core", the added amount of C.I. Pigment Red 146 was changed from 4.8 parts to 4.4 parts, and the added amount of C.I. Solvent Violet 59 was changed from 1.2 parts to 1.1 parts.

<Colored Resin Particles (3)>

Colored resin particles (3) were obtained in the same manner as the production method of the colored resin particles (1), except that in the "Preparation of polymerizable monomer composition for core", the added amount of C.I. Pigment Red 146 was changed from 4.8 parts to 4.4 parts, and the added amount of C.I. Solvent Violet 59 was changed from 1.2 parts to 1.1 parts, and 1.0 parts of C.I. Pigment Red 122 (represented by the following formula (X), CAS No. 16043-40-6, manufactured by: Meghmani corporation, product name: HOSTAPERM PINK E) as a magenta colorant was added.

Formula (X)

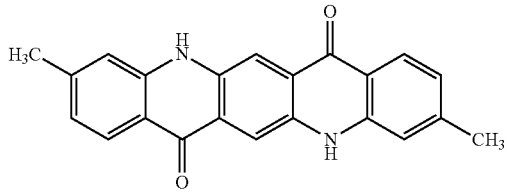

<Colored Resin Particles (4)>

Colored resin particles (4) were obtained in the same manner as the production method of the colored resin particles (1), except that in the "Preparation of polymerizable monomer composition for core", the compound A was changed from C.I. Pigment Red 146 to C.I. Pigment Red 147 (represented by the following formula (1B), CAS No. 68227-78-1, manufactured by: Clariant Corp., product name: PERMANENT PINK F3B), and the added amount of the compound A was changed from 4.8 parts to 4.4 parts, and the added amount of C.I. Solvent Violet 59 was changed from 1.2 parts to 1.1 parts.

Formula (1B)

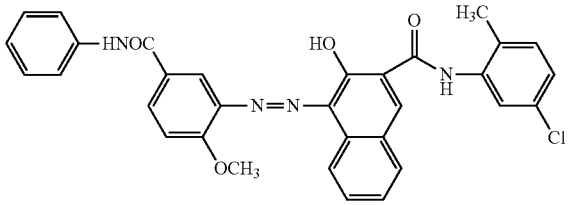

<Colored Resin Particles (5)>

Colored resin particles (5) were obtained in the same manner as the production method of the colored resin particles (1), except that in the "Preparation of polymerizable monomer composition for core", the added amount of C.I. Pigment Red 146 was changed from 4.8 parts to 3.5 parts, and 1.2 parts of C.I. Solvent Violet 59 was changed to 3.5 parts of C.I. Pigment Red 122.

<Colored Resin Particles (6)>

Colored resin particles (6) were obtained in the same manner as the production method of the colored resin particles (1), except that in the "Preparation of polymerizable monomer composition for core", 4.8 parts of C.I. Pigment Red 146 was changed to 3.0 parts of C.I. Pigment Red 185 (represented by the following formula (Y), CAS No. 51920-12-8, manufactured by: Clariant Corp., product name: NOVOPERM CARMINE HF4C), and 1.2 parts of C.I. Solvent Violet 59 was changed to 2.0 parts of C.I. Pigment Red 122.

Formula (Y)

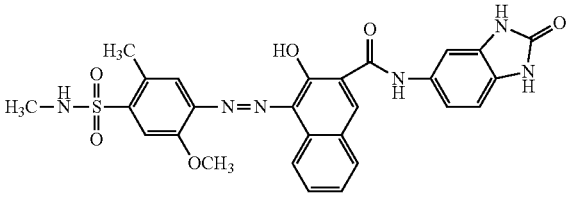

2. Production of Magenta Toner

The colored resin particles (1) to (6) were subjected to the treatment with the external additives to produce magenta toners of Examples 1 to 4 and Comparative Example 1 and Comparative Example 2.

Example 1

First, 0.6 part of hydrophobized silica fine particles having an average particle diameter of 7 nm and 1 part of hydrophobized silica fine particles having an average particle diameter of 35 nm, were added to 100 parts of the colored resin particles (1). They were mixed by means of a high-speed mixer (product name: FM MIXER, manufactured by: Nippon Coke & Engineering Co., Ltd.) to prepare the magenta toner of Example 1.

Examples 2 to 4 and Comparative Examples 1 and 2

The magenta toners of Examples 2 to 4 and Comparative Examples 1 and 2 were obtained in the same manner as Example 1, except that the colored resin particles (1) were changed to, as shown in the following Table 1, any one of the colored resin particles (2) to (6).

3. Evaluation of Toner for Developing Electrostatic Images

Measurement of reflection density (image density), charge amount (blow-off charge amount), fog under a normal-temperature and normal-humidity (N/N) environment, fixing temperature (minimum fixing temperature), and heatproof temperature were carried out on the magenta toners of Examples 1 to 4 and Comparative Examples 1 and 2 as follows.

3-1. Measurement of Image Density

A commercially-available, non-magnetic one-component development color printer (printing rate: 20 sheets/min) was used. The toner cartridge of the development device was filled with a sample magenta toner, and printing sheets were loaded in the printer. Then, the printer was left to stand under an (N/N) environment, namely at a temperature of 23° C. and a relative humidity of 50%, for one day. Then, while the amount of the toner supplied onto the developing roller in solid pattern printing was fixed at 0.5 mg/cm$^2$, sheets were continuously printed at an image density of 5%. Solid pattern printing (image density: 100%) was carried out on the tenth sheet. Using a McBeth transmitting image densitometer, the image density of the tenth sheet were measured. It is preferable that image density is 1.20 or more.

3-2. Blow-Off Charge Amount 9.5 g of a carrier (manufactured by Powdertech Corporation, product name: EF80B2, Mn—Mg—Sr base soft ferrite, average particle diameter: 80 μm, particle size distribution: 50-100 μm) and 0.5 g of a toner were weighed and charged in a volume 30 mL glass container, and the toner particles were tribocharged by rotating the container at 150 rpm for 30 minutes. The blow-off charge amount was measured by blowing the obtained mixture of the carrier and the toner particles off with nitrogen gas at a pressure of 1 kg/cm$^2$ using a blow-off meter (manufactured by Toshiba Chemical Corporation, product name: TB-200).

3-3. Measurement of Fog Under a Normal-Temperature and Normal-Humidity (N/N) Environment A commercially-available, non-magnetic one-component development printer and a toner which is an evaluation target were left to stand under an (N/N) environment, namely at a temperature of 23° C. and a relative humidity of 50%, for one day, and then the fog was measured.

A measuring method for fog was as follows. First, a hue of a paper which had not been used yet was measured and the obtained hue was decided as a standard value ($E_0$). Next, a white solid pattern was printed with the use of the toner by the printer which is the same as used in the above described "3-1. Measurement of image density", and then hues ($E_1$ to $E_6$) at six portions arbitrarily selected on the white solid pattern are measured respectively. Differences (ΔE) between any one of the hues ($E_1$ to $E_6$) and the standard value ($E_0$) were calculated respectively. Then, the maximum ΔE was regarded as a fog value, and a degree of fog was evaluated as described below. The smaller fog value indicates that fog is less, and printing is better. Incidentally, the hue was measured by a spectrophotometer (manufactured by X-rite Corporation, product name: SPECTROEYE).

A: ΔE is less than 0.5.

B: ΔE is 0.5 or more and less than 1.5.

F: ΔE is 1.5 or more.

3-4. Minimum Fixing Temperature

A commercially-available, non-magnetic one-component development printer (device with 24 sheets-performance; printing speed=24 sheets/minute) was modified so as that the temperature of its fixing roll can be varied, and the modified printer was used. The printer was operated while the temperature of fixing roll was varied, and a fixing rate of the toner at each temperature was measured, thereby finding a relationship between the temperature and the fixing rate. Then, the minimum temperature that gives 80% or more of the fixing rate was defined as the minimum fixing temperature.

The fixing rate was calculated from the ratio of image densities before and after operating a rubbing test which was applied to an area of a solid pattern on a test paper which was printed by the printer. Specifically, assuming that the image density before the rubbing test is ID (before), and the image density after the rubbing test is ID (after), the fixing rate can be calculated by the following Calculation Formula:

$$\text{Fixing rate (\%)}=(\text{ID (after)}/\text{ID (before)})\times 100$$

Here, the area of the solid pattern means an area controlled so as to adhere a developer to all dots which are virtual dots for controlling a printer controlling section and present in the area. The operation of the rubbing test is a series of actions in which a measuring portion of the test paper is attached to a fastness tester by an adhesive tape, and the measuring portion is loaded with 500 g of load, and then rubbed five times in reciprocating motion with a rubbing piece wrapped with a cotton cloth.

3-5. Heatproof Temperature of Toner 10 g of toner was placed in a 100 mL polyethylene container and the container was sealed. Then, the container was set in a constant temperature water bath which was set to a predetermined temperature. After 8 hours, the container was taken out from the constant temperature water bath. The toner was removed from the thus taken container so as not to bring vibration to toner insofar as possible, and put on a 42-mesh sieve. The sieve on which the toner was put was set on a powder characteristic tester (manufactured by Hosokawa Micron Corporation, product name: POWDER TESTER PT-R). Then, the sieve was vibrated for 30 seconds under the condition of amplitude of 1.0 mm. Thereafter, the mass of the toner remained on the sieve was measured, and the thus-measured value was referred to as an aggregated toner mass.

The maximum temperature at which the aggregated toner mass is 0.5 g or less was regarded as a Heatproof temperature.

Table 1 shows the measurement and evaluation results of the magenta toners of Examples 1 to 4 and Comparative Examples 1 and 2, along with the toner composition.

In the following Table 1, "PR146" means C.I. Pigment Red 146; "PR147" means C.I. Pigment Red 147; "SV59" means C.I. Solvent Violet 59; "PR122" means C.I. Pigment Red 122; and "PR185" means C.I. Pigment Red 185. "Compound A+Compound B (part)" means the sum of the added amount of the compound A and that of the compound B, and "Compound A/Compound B ratio" means the ratio of the added amount of the compound A to that of the compound B.

TABLE 1

| | Example 1 | Example 2 | Example 3 | Example 4 |
|---|---|---|---|---|
| Colored resin particles | Particle(1) | Particle(2) | Particle(3) | Particle(4) |
| Compound A | PR146 | PR146 | PR146 | PR147 |
| Added amount (parts) | 4.8 | 4.4 | 4.4 | 4.4 |
| Compound B | SV59 | SV59 | SV59 | SV59 |
| Added amount (parts) | 1.2 | 1.1 | 1.1 | 1.1 |
| Compound A + Compound B (parts) | 6.0 | 5.5 | 5.5 | 5.5 |
| Compound A/Compound B ratio | 4.0 | 4.0 | 4.0 | 4.0 |
| Other magenta colorant | — | — | PR122 | — |
| Added amount (parts) | — | — | 1.0 | — |
| Amount of toner loaded on sheet (mg/cm2) | 0.50 | 0.51 | 0.49 | 0.50 |
| Reflection density | 1.25 | 1.33 | 1.33 | 1.35 |
| Blow-off charge amount (μC/g) | −49 | −56 | −37 | −28 |
| N/N fog | A | A | B | B |
| Minimum fixing temperature (° C.) | 125 | 125 | 125 | 125 |
| Heatproof temperature (° C.) | 52 | 52 | 51 | 52 |

| | Comparative Example 1 | Comparative Example 2 |
|---|---|---|
| Colored resin particles | Particle(5) | Particle(6) |
| Compound A | PR146 | — |
| Added amount (parts) | 3.5 | — |
| Compound B | — | — |
| Added amount (parts) | — | — |
| Compound A + Compound B (parts) | 3.5 | — |
| Compound A/Compound B ratio | — | — |
| Other magenta colorant | PR122 | PR185 + PR122 |
| Added amount (parts) | 3.5 | 3.0 + 2.0 |
| Amount of toner loaded on sheet (mg/cm2) | 0.50 | 0.49 |
| Reflection density | 1.24 | 1.16 |
| Blow-off charge amount (μC/g) | −21 | −43 |
| N/N fog F A | | |
| Minimum fixing temperature (° C.) | 130 | 130 |
| Heatproof temperature (° C.) | 52 | 52 |

4. Evaluation of Toners

The magenta toner of Comparative Example 1 is a toner using the compound A (C.I. Pigment Red 146) in combination with C.I. Pigment Red 122. For Comparative Example 1, the absolute value of the blow-off charge amount is as small as 21, and an occurrence of the fog under the N/N environment is much. Therefore, it is found that the charge amount of the toner is insufficient when C.I. Pigment Red 122 is used in place of the compound B.

The magenta toner of Comparative Example 2 is a toner using C.I. Pigment Red 185 in combination with C.I. Pigment Red 122. For Comparative Example 2, the absolute value of the blow-off charge amount is 43, and a problem of the fog under the N/N environment is not observed. For Comparative Example 2 however, the image density (reflection density) is as small as 1.16. This value of image density is the smallest among the evaluated toners. Therefore, it is found that the image density is not likely to get sufficient when any pigments are used in combination as the magenta colorant.

Meanwhile, the magenta toners of Examples 1 to 4 are toners in which, the compound A and the compound B are contained as the magenta colorant at 5.5 to 6.0 parts by mass in total with respect to 100 parts by mass of the binder resin, and a mass ratio of the content of the compound A to the content of the compound B (compound A/compound B ratio) is 4.0. For the toners of Examples 1 to 4, since the image density (reflection density) is as high as 1.25 or more, the image density is excellent. Also in Examples 1 to 4, the absolute value of the blow-off charge amount is as large as 28 or more, and the charge amount is enhanced in comparison with the toner of Comparative Example 1 in which pigments are combined and used, and thereby the fog is not likely to occur.

Besides, the toners of Examples 1 to 4 can be produced at a low cost, because they use C.I. Pigment Red 146 or C.I. Pigment Red 147 which are cheaper in comparison with the quinacridone base pigment.

Therefore, it is found that the magenta toners of Examples 1 to 4 in which, the compound A and the compound B are contained as the magenta colorant at 3 to 30 parts by mass in total with respect to 100 parts by mass of the binder resin, and a mass ratio of the content of the compound A to the content of the compound B (compound A/compound B) is 0.8 to 20 is excellent in image density, and has an enhanced chargeability, and can be produced at a low cost.

The invention claimed is:

1. A magenta toner comprising a binder resin and a magenta colorant, wherein a compound A represented by the following general formula (1) and C.I. Solvent Violet 59 are contained as the magenta colorant, and wherein a total content of the compound A and the C.I. Solvent Violet 59 is from 3 to 30 parts by mass with respect to 100 parts by mass of the binder resin, and a mass ratio of the content of the compound A to the content of the C.I. Solvent Violet 59 (compound A/C.I. Solvent Violet 59) is from 0.8 to 20:

General Formula (1)

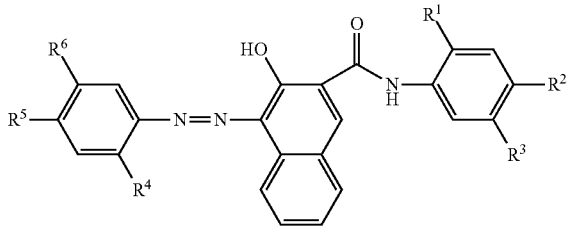

where $R^1$ is a hydrogen atom, an alkyl group or an alkoxy group;

$R^2$ is a hydrogen atom, a halogen atom or an alkoxy group;

$R^3$ is a hydrogen atom, a halogen atom, an alkoxy group or a nitro group;

$R^4$ is a hydrogen atom, a halogen atom or an alkoxy group;

$R^5$ is a hydrogen atom, a halogen atom or a primary amide group (—$CONH_2$); and $R^6$ is a hydrogen atom, a halogen atom, a phenylaminocarbonyl group (—$CONHC_6H_5$), a primary amide group (—$CONH_2$), —$CONHC_6H_4$-(p)$CONH_2$ or —$SO_2$ $(C_2H_5)_2$.

2. The magenta toner according to claim 1, wherein the compound A is a compound represented by the General Formula (1) in which:

$R^1$ is a methyl group or an alkoxy group;

$R^2$ is a hydrogen atom or a halogen atom;

$R^3$ is a halogen atom or an alkoxy group;

$R^4$ is an alkoxy group;

$R^5$ is a hydrogen atom; and $R^6$ is a phenylaminocarbonyl group (—$CONHC_6H_5$).

3. The magenta toner according to claim 1, wherein the compound A is C.I. Pigment Red 146 or C.I. Pigment Red 147.

4. The magenta toner according to claim 1, wherein an absolute value of a blow-off charge amount measured by a blow-off charge amount measuring device is in a range of from 25 μC/g to 90 μC/g.

* * * * *